US005210992A

United States Patent [19]

Focke

[11] Patent Number: 5,210,992

[45] Date of Patent: May 18, 1993

[54] APPARATUS FOR SHAPING AND FOR SETTING THE GLUE OF CUBOIDAL (CIGARETTE) PACKS

[75] Inventor: Heinz Focke, Verden, Fed. Rep. of Germany

[73] Assignee: Focke & Co., Verden, Fed. Rep. of Germany

[21] Appl. No.: 794,949

[22] Filed: Nov. 20, 1991

[30] Foreign Application Priority Data

Nov. 27, 1990 [DE] Fed. Rep. of Germany ..... 4037692

[51] Int. Cl.[5] ..... B65B 61/24; B65B 5/10; B65B 5/12

[52] U.S. Cl. ..... 53/387.3; 53/113; 493/142

[58] Field of Search ..... 53/387.3, 387.2, 387.1, 53/113, 526, 527; 493/142, 206; 156/69

[56] References Cited

U.S. PATENT DOCUMENTS

| | | | |
|---|---|---|---|
| 1,764,508 | 6/1930 | Fulco | 53/387.3 |
| 2,697,474 | 12/1954 | McGinley | 53/387.3 X |
| 3,488,914 | 1/1970 | Csernak | 53/551 X |
| 4,079,570 | 3/1978 | Rucker | 493/206 X |
| 4,085,568 | 4/1978 | Focke et al. | 53/387.2 X |
| 4,173,921 | 11/1979 | Mack | 493/142 |
| 4,179,864 | 12/1979 | Focke | 53/387.3 |
| 4,636,186 | 1/1987 | Focke et al. | 53/387.3 X |
| 4,843,800 | 7/1989 | Focke | 53/387.3 X |
| 4,942,715 | 7/1990 | Focke | 53/387.3 X |
| 4,979,349 | 12/1990 | Focke | 53/387.2 X |

FOREIGN PATENT DOCUMENTS

| | | |
|---|---|---|
| 2632968 | 1/1978 | Fed. Rep. of Germany . |
| 3615827 | 11/1987 | Fed. Rep. of Germany . |
| 3736403 | 5/1989 | Fed. Rep. of Germany . |
| 273086 | 6/1927 | United Kingdom . |
| 1176733 | 1/1970 | United Kingdom . |

*Primary Examiner*—Horace M. Culver
*Attorney, Agent, or Firm*—Sughrue, Mion, Zinn, Macpeak & Seas

[57] ABSTRACT

Drying turrets (10) serve for stabilizing the shape of cigarette packs (13) immediately after their completion. For this purpose, the drying turret (10) is provided with a plurality of pockets (11) for receiving the cuboidal cigarette packs (13) in a positive manner. To locally increase the pressure exerted on the cigarette packs (13), at least one of the pocket walls (partition wall 18, inner wall 21, outer wall 23) defining the pocket (11) is provided with a shoulder (37) which exerts the locally increased pressure on the cigarette pack (13) in the pocket (11). This shoulder (37) is particularly arranged in the middle region of a partition wall (18) on a side confronting a pack front panel (14). As a result, the pressure in the region of adhesive bonds (glue spots 33, 34) located in the region of the pack front panel (14) is increased.

2 Claims, 3 Drawing Sheets

APPARATUS FOR SHAPING AND FOR SETTING THE GLUE OF CUBOIDAL (CIGARETTE) PACKS

BACKGROUND OF THE INVENTION

The invention relates to an apparatus for shaping cuboidal (cigarette) packs immediately after their completion and for setting glue points of the packs, in which apparatus several pockets, for receiving at least one pack each and having a cross-section corresponding to the shape of the pack, are arranged on a common conveyor and thus form a drying turret.

Such drying turrets are part of packaging machines for the production of cuboidal packs with adhesively bonded folding tabs. These drying turrets are especially found in cigarette packaging machines. The adhesively bonded folding tabs of such cigarette packs require a minimum period for a hardening of the glue and therewith for a stabilization of the shape of the pack.

Such a drying turret for receiving cigarette packs of the hinge-lid pack type is for example disclosed in U.S. Pat. No. 4,084,393. A plurality of pockets arranged along the periphery of the drying turret serve for receiving one cigarette pack each. The cross-section of the pockets is adapted to the dimensions of the packs. The panels of the pack are subjected to a small shaping pressure. In addition, the pockets are heated in order to accelerate a setting of the glue.

A further development of such a drying turret is disclosed in U.S. Pat. No. 4,942,715. This publication also shows proposals for an efficient feeding of the packs to the drying turret and for discharging the hardened packs.

SUMMARY OF THE INVENTION

The present invention is concerned with a further development of such drying turrets. The invention is based on the object to design the drying turret or rather its pockets in such a way that individual characteristics of the (cigarette) packs which are to be treated are taken into account for the shaping of the packs and the hardening of glue points.

To attain this object, the apparatus according to the invention is characterized in that pocket walls defining the pockets are provided with rib-like elevations or projections in regions for creating an increased contact pressure on the packs.

The invention is based on the finding that because of the structure of cigarette packs, especially because of the provision of specific glue points of the packs, it is desirable to locally increase the pressure exerted on the packs in the pockets of the drying turret. This specific increase of pressure is achieved by appropriate elevations or projections on the pocket walls, because these elevations or projections locally transfer a higher pressure to the packs.

It is necessary to increase the contact pressure in partial regions in the case of cigarette packs having glue points which are needed for a proper operation of the pack and are located in the region of a pack front panel, especially in the region of a lid front panel. According to the invention, rib-like projections are provided for such packs in a middle region of a pocket wall contacting the pack front panel. The elevation or projection can be designed as a strip-like rib located on the pocket wall confronting the pack front panel.

Further details of the invention relate to the structure of the pockets of the drying turret and to further details of the drying turret.

BRIEF DESCRIPTION OF THE DRAWINGS

An exemplary embodiment of a drying turret designed as taught by the invention will be described below in detail with reference to the drawings, in which.

DESCRIPTION OF A PREFERRED EMBODIMENT

Figure 1:
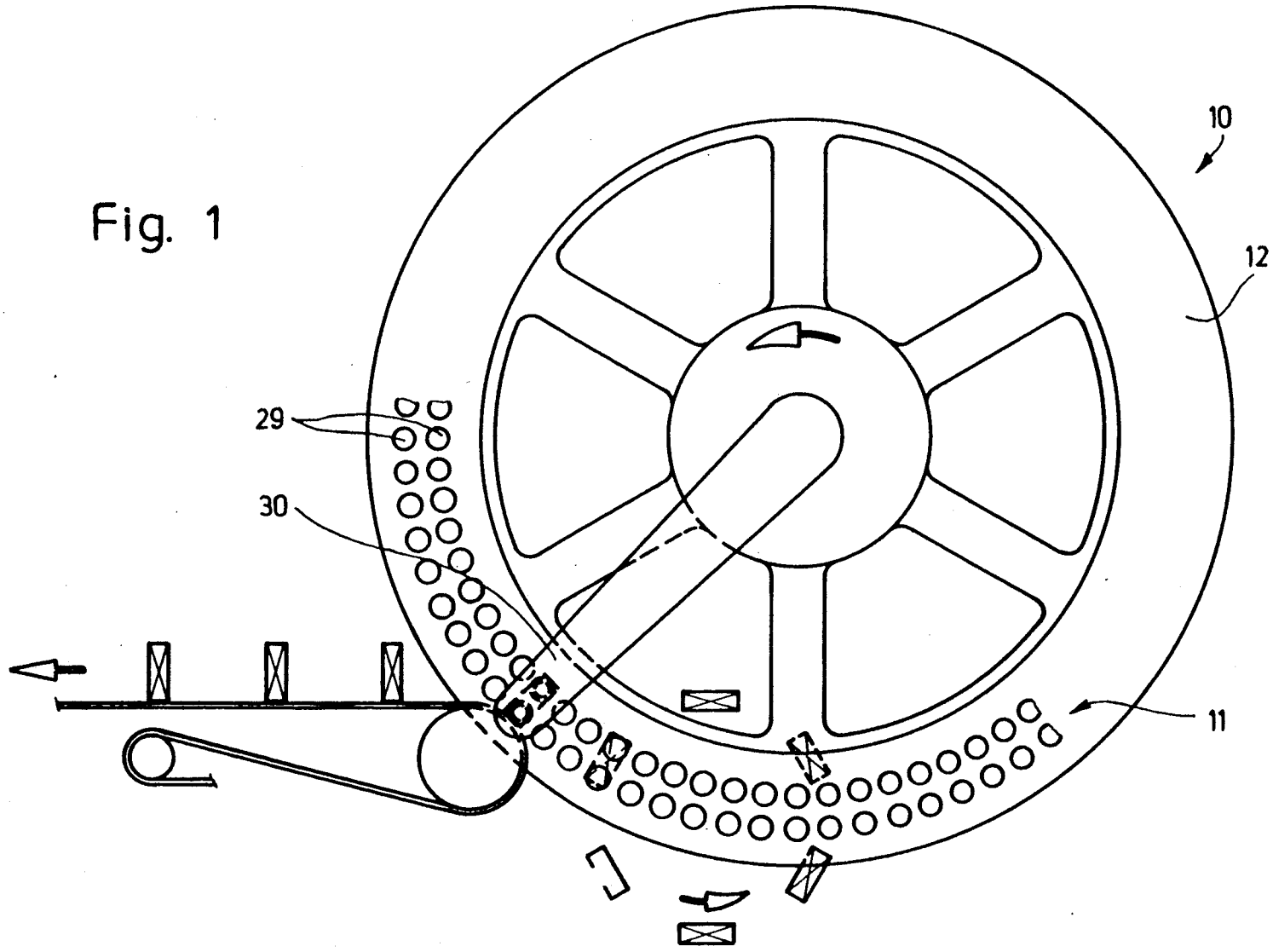
FIG. 1 is a rear view of a drying turret.
Figure 2:
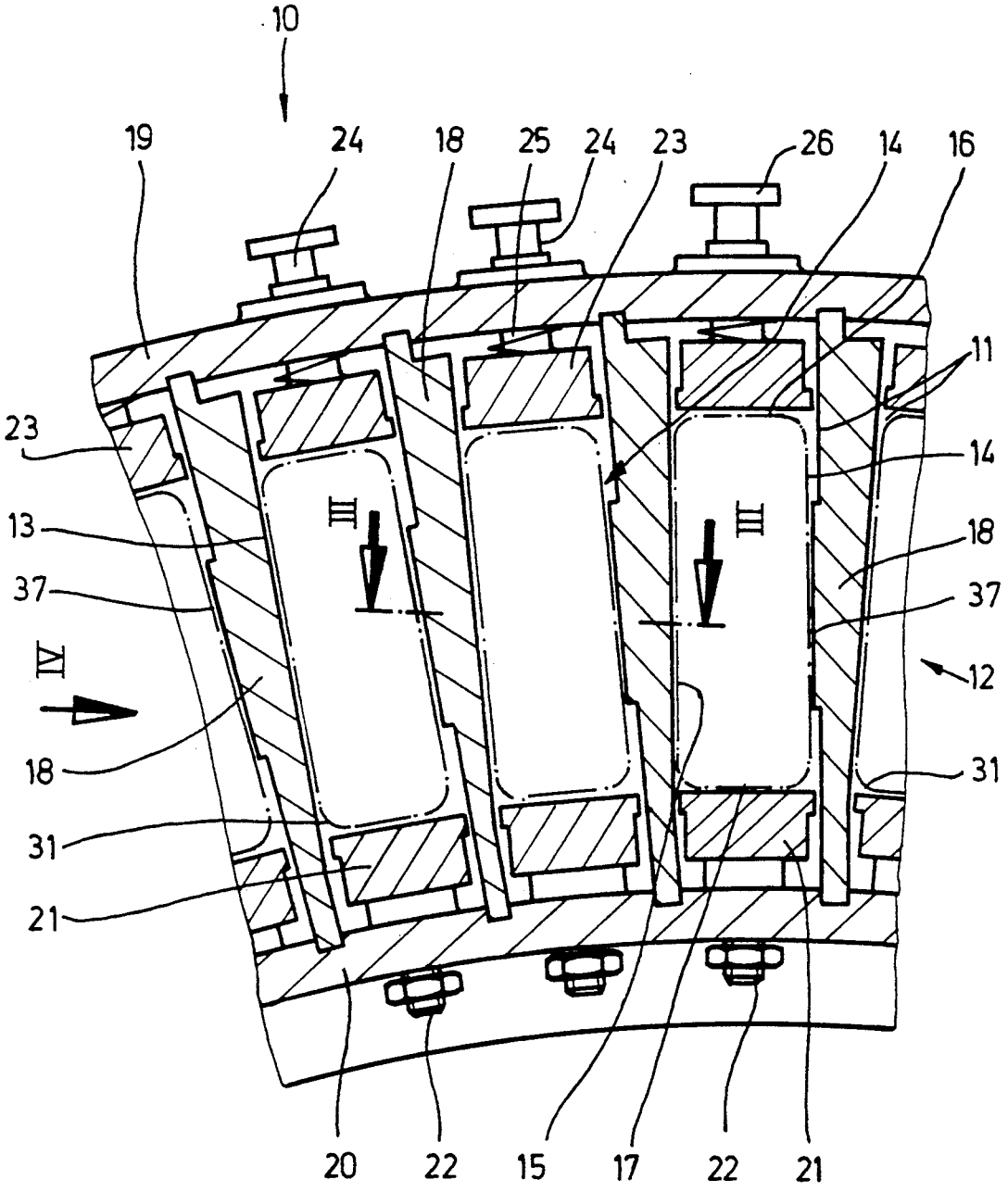
FIG. 2 is a fragmentary sectional view in the peripheral direction of a drying turret with a plurality of pockets, on an enlarged scale.
Figure 3:
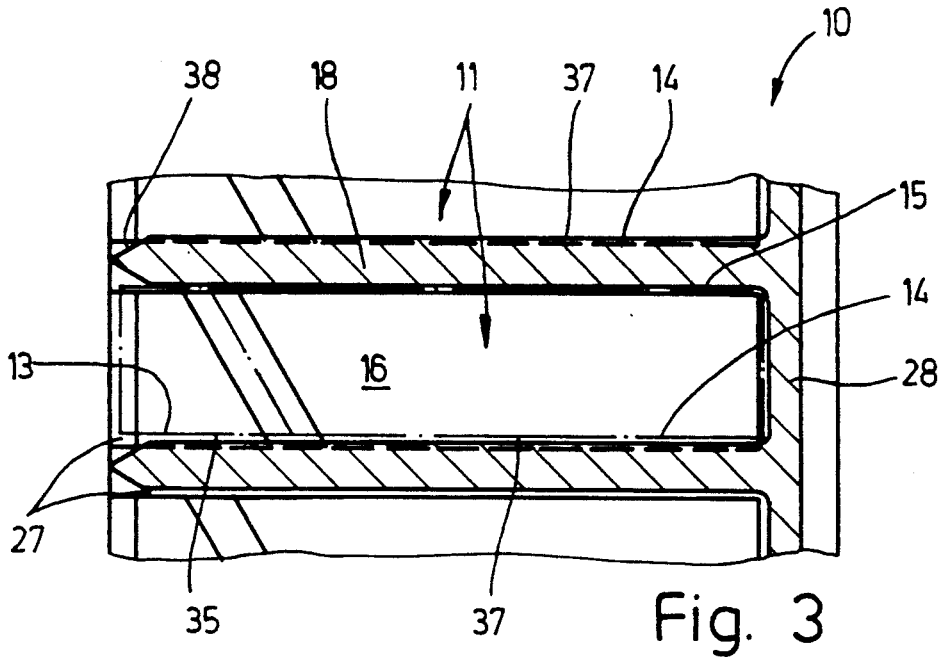
FIG. 3 is a cross-section of a pocket according to cutting plane III—III of FIG. 2.
Figure 4:
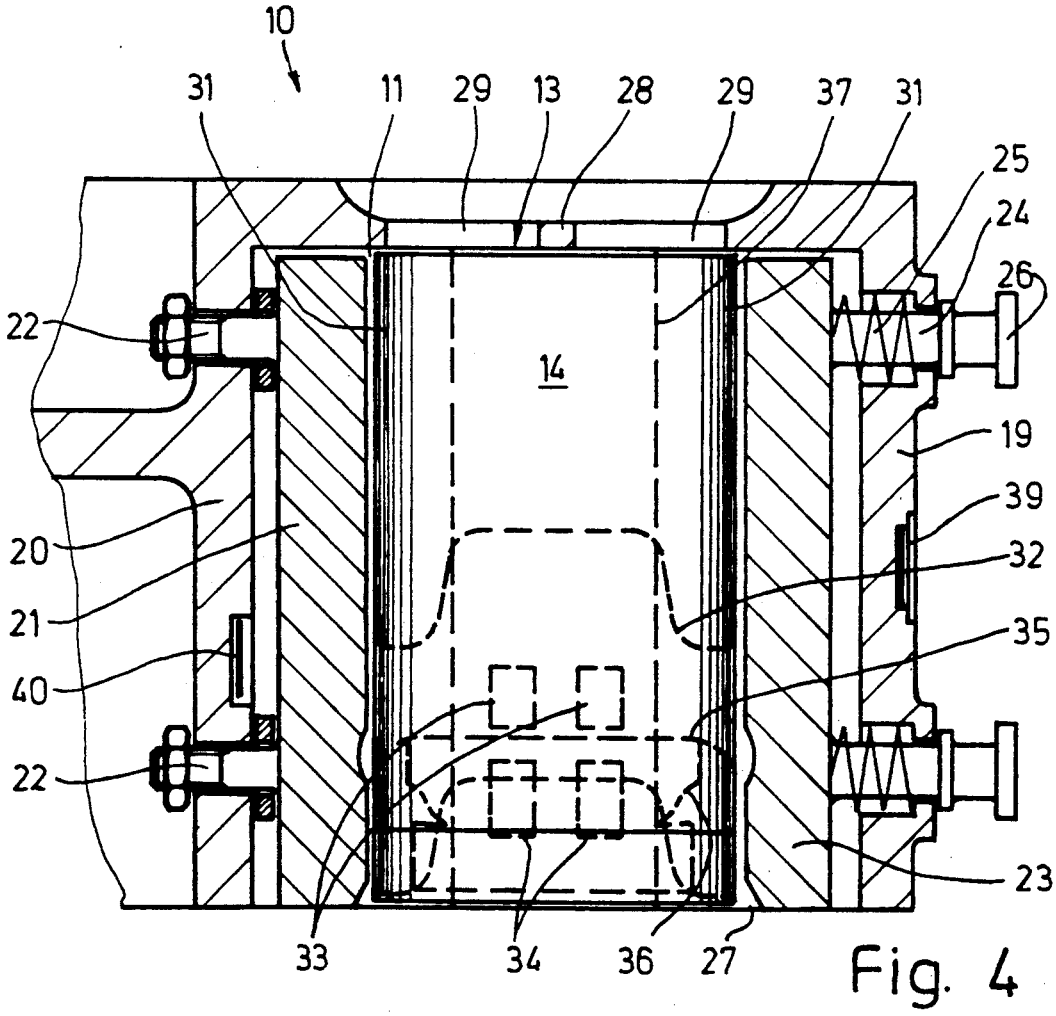
FIG. 4 shows a view of a pocket according to arrow IV of FIG. 2.

The exemplary embodiment illustrated is concerned with details of a drying turret 10 which is also illustrated and described with the associated transport means for example in U.S. Pat. No. 4,942,715, but in an embodiment with two rows of pockets. The present exemplary embodiment is provided with one row of pockets 11 which are arranged on the outer periphery of the drying turret 10 in the region of a pocket ring 12.

Each pocket 11 serves for receiving an (approximately) cuboidal cigarette pack 13 which is bounded by pocket walls within the pocket 11 in the region of a pack front panel 14, a pack rear panel 15 and in the region of (narrow and elongated) side panels 16, 17. The pocket walls rest against the associated pack surfaces in order to form or stabilize the shape of the pack.

The pockets 11 are arranged in the radial direction in a fan-like manner, such that the narrow side panels 16, 17 are located on the outside and inside in the radial direction. The front panels 14 and rear panels 15 are thus directed in the peripheral direction.

Pack front panel 14 and pack rear panel 15 are bounded by radially directed and web-like partition walls 18 which, as a result of their radial orientation, have a cuneiform cross-section. The partition walls 18 are on the radial outside and inside connected to an outer ring 19 and an inner ring 20.

The side panels 17 pointing to the inside in the radial direction rest against an inner wall 21 which can be accurately positioned by means of adjusting screws 22. On the opposite side there is an outer wall 23, which contacts the confronting side panel 16 of the cigarette pack 13 under resilient pressure. The outer walls 23 are mounted with shiftable pins 24 comprising pressure springs 25. To insert and to eject the cigarette packs 13 into and out of the pockets 11, the outer walls 23 can be retracted in the radial direction against the outer ring 19, specifically by means of pulling the pins 24. These pins 24 are provided with heads 26 so that they can be engaged by appropriate means.

To insert and eject the cigarette packs, the pockets 11 are provided in an axis-parallel direction with an insert orifice 27 which has a cross-section corresponding to that of the pocket 11. On the opposite side, a pocket bottom 28 is provided with bores 29 for an ejector 30 to pass through.

Pocket walls defining the pockets 11 are provided with elevations in order to locally increase the pressure exerted on the cigarette pack 13 while glue points are setting. The exemplary embodiment illustrated is primarily concerned with the treatment of cigarette packs 13 having a specific structure, in particular packs with rounded longitudinal edges 31. The cigarette pack 13 corresponds to that of German Patent Application P 39 42 034.5. Regarding the adhesive bonding of parts of the cigarette pack 13, the pack front panel is of particular interest. On the one hand, a collar 32 is attached to the pack front panel 14 with two rectangular glue spots 33 which are located at a small distance from one another in the middle region of the pack front panel 14.

Furthermore, two glue spots 34 are located in the region of a lid front panel 35. These glue spots 34 serve for fixing an inner tab 36 at the inside of the lid front panel 35. These glue spots 34 are also located in the middle region of the pack front panel 14.

To exert an increased pressure on the above mentioned adhesive bonds while the glue is setting, the pocket wall which confronts the pack front panel 14, i.e. the partition wall 18, is provided with a rib-like or web-like elevation or shoulder 37 which extends in the form of a strip-like projection over the entire length of the partition wall 18 on the side which confronts the pack front panel 14. Consequently, an increased pressure is exerted on the pack front panel 14 within the pocket 11. This pressure particularly takes effect in the region of the glue spots 33 and 34, so that the collar 32 is pressed against the pack front panel 14 and the inner tab 36 against the lid front panel 35.

To facilitate the insertion of the cigarette packs 13 into the pockets 11, the partition walls 18 are provided with inclined faces 38 in the region of the insert orifice 27. These inclined faces 38 also extend in the region of the elevation 37.

In the pockets 11, the cigarette packs 13 are exposed to an elevated temperature to set the glue. In the present exemplary embodiment, the outer ring 19 is provided with a heating 39 extending all around. This heating 39 is an electric resistance heating and is located approximately in a mid-plane in relation to the inner dimension of the pockets 11 and thus in a middle region of the cigarette pack 13 in the pocket 11.

The inner ring 20 is also provided with a heating 40 which is also a band-shaped electric resistance heating. This heating is offset to the middle of the pockets 11, particularly in the direction towards the region of the glue spots 33, 34. In this region comprising a plurality of adhesive bonds, the cigarette pack 13 is to be exposed to an increased drying temperature.

I claim:

1. An apparatus for shaping cuboidal cigarette packs of the hinge-lid type immediately after their completion and for setting spaced-apart glue spots (33, 34) in a region of a collar (32) connected to a front panel (14) of each pack and in a region of an inner tab (36) connected to an inner side of a front panel (35) of the lid of each pack, said apparatus comprising:

a) a plurality of pockets (11) disposed next to one another on a common conveyor (10), b) each pocket (11) having a cross-section that corresponds to the cuboidal shape of a pack and being designed to receive one pack; and c) a plurality of pairs of stationary partition walls (18) defining said pockets, each partition wall (18) having a first side resting against a pack front panel (14), and a second side resting against a rear panel (15) of the pack, d) each pocket (11) comprising an insert orifice (27) for one pack and a pocket bottom (28) located opposite said orifice;

e) said first side of each partition wall (18) having a strip-like shoulder (37) which projects inwardly of the pocket and which rests against the pack front panel (14);

f) said strip-like shoulder (37) having a width that is slightly greater than that of a pack front panel middle region defined by the spaced-apart glue spots (33, 34);

g) the strip-like shoulder (37) extending from said insert opening (27) to said pocket bottom (28).

2. The apparatus as claimed in claim 1, wherein said partition walls (18) and said shoulder (37) have inclined surfaces (38) at the insert opening (27).

* * * * *